US010118358B2

(12) United States Patent
Houle

(10) Patent No.: US 10,118,358 B2
(45) Date of Patent: Nov. 6, 2018

(54) SCREW PRESS FOR SEPARATION OF LIQUID FROM BULK MATERIALS

(71) Applicant: US FARM SYSTEMS, INC., Tulare, CA (US)

(72) Inventor: Rejean Houle, Tulare, CA (US)

(73) Assignee: US FARM SYSTEMS, INC., Tulare, CA (US)

( * ) Notice: Subject to any disclaimer, the term of this patent is extended or adjusted under 35 U.S.C. 154(b) by 989 days.

(21) Appl. No.: 14/578,859

(22) Filed: Dec. 22, 2014

(65) Prior Publication Data

US 2016/0176141 A1 Jun. 23, 2016

(51) Int. Cl.
*B30B 9/00* (2006.01)
*B30B 9/12* (2006.01)
*B30B 9/18* (2006.01)

(52) U.S. Cl.
CPC ..... *B30B 9/128* (2013.01); *B30B 9/12* (2013.01); *B30B 9/18* (2013.01)

(58) Field of Classification Search
CPC .... B30B 9/00; B30B 9/14; B30B 9/18; B30B 9/128; B30B 15/00; B30B 3/04; B01D 35/00; B01D 29/88; B01D 29/90; B01D 29/117; B01D 29/6476
USPC ..... 100/117, 145–150; 210/128, 129, 415, 210/446
See application file for complete search history.

(56) References Cited

U.S. PATENT DOCUMENTS 332,718 A * 12/1885 Lafferty ..... A47J 19/06 100/125
1,527,911 A * 2/1925 Patti ..... B30B 9/12 100/148
3,394,649 A 7/1968 Kemper et al.
3,688,687 A * 9/1972 Craig ..... B30B 9/128 100/117
4,421,937 A * 12/1983 Lynch ..... C07C 7/14 100/117
4,651,637 A * 3/1987 Steinke ..... B30B 9/128 100/117
4,852,817 A * 8/1989 Tipton ..... B02C 19/0081 100/148
5,129,590 A * 7/1992 Shinya ..... B30B 9/128 100/117
5,146,841 A * 9/1992 Zittel ..... A23B 7/06 100/117

(Continued)

*Primary Examiner* — Jason Daniel Prone
(74) *Attorney, Agent, or Firm* — Glass & Associates; Kenneth D'Alessandro; Kenneth Glass

(57) ABSTRACT

A screw press liquid separator includes a perforated screw cradle disposed within a housing. A screw is formed on a shaft within the screw cradle. A second portion of the screw extends to a discharge end and is completely surrounded by a compression portion of the cradle. A first portion of the shaft has a first diameter extending the length of the screw, and a second portion of the shaft within the compression portion and extending past the output end of the screw has a second larger diameter. A transition portion of the shaft tapers from the second diameter to the first diameter. Discharge guides extend from the discharge end of the housing. Discharge doors are pivotally mounted to the discharge end of the housing and are biased to close against the discharge end of the housing. Paddles radially extend from the shaft outside of the discharge doors.

10 Claims, 3 Drawing Sheets

(56) References Cited

U.S. PATENT DOCUMENTS 5,370,323 A * 12/1994 Narao ..... B30B 9/121 100/117
5,421,251 A * 6/1995 Bruke ..... B30B 9/12 100/117
5,466,370 A * 11/1995 Day ..... B01D 21/0018 100/117
5,515,776 A 5/1996 Scheucher et al.
5,653,879 A * 8/1997 Schroeder ..... B01D 29/25 100/117
5,669,291 A * 9/1997 Ii ..... A01J 25/111 100/117
5,699,728 A * 12/1997 Huang ..... B30B 9/128 100/117
5,715,747 A * 2/1998 Fedon ..... B30B 9/12 100/117
5,906,154 A * 5/1999 Yoon ..... B30B 9/121 100/117
6,588,331 B2 * 7/2003 Thibodeau ..... B30B 9/12 100/117
6,634,508 B1 * 10/2003 Ishigaki ..... B30B 9/12 100/117
6,736,054 B2 * 5/2004 Dionne ..... B30B 9/12 100/117
7,073,433 B2 * 7/2006 Burke ..... B30B 9/121 100/117
7,143,690 B2 * 12/2006 Borjesson ..... B30B 9/121 100/117
7,357,074 B2 4/2008 Kraft et al.
8,025,156 B2 * 9/2011 Tapp ..... B01D 29/6476 100/117
8,087,353 B2 * 1/2012 Passerini ..... B01D 29/6476 100/117
8,151,702 B2 * 4/2012 Marchesini ..... B30B 9/18 100/117
8,191,470 B2 * 6/2012 Magor ..... B30B 9/121 100/117
8,333,282 B2 * 12/2012 Pallmann ..... B30B 9/12 100/117
8,388,836 B1 * 3/2013 Fetterman, III ... B01D 29/6476 100/117
8,562,832 B2 * 10/2013 Houle ..... B01D 33/0361 210/255
8,661,972 B2 * 3/2014 Czwaluk ..... B30B 9/18 100/117
8,695,804 B2 * 4/2014 Bennington, II .. B01D 29/6476 209/270
8,726,803 B2 * 5/2014 Ceccarelli ..... B30B 9/122 100/117
8,851,409 B2 * 10/2014 Koenig ..... B29B 17/0052 100/117
8,863,656 B2 * 10/2014 Trovinger ..... A23N 1/02 100/117
8,881,648 B2 * 11/2014 Yamashita ..... B01D 29/35 100/117
9,003,968 B2 * 4/2015 Kozanda ..... B30B 9/12 100/117
2001/0039887 A1 * 11/2001 Reddoch ..... B30B 9/18 100/117
2002/0096061 A1 * 7/2002 Swiatlo ..... B30B 9/18 100/117
2005/0189287 A1 * 9/2005 Lin ..... B30B 9/128 100/117
2008/0028952 A1 * 2/2008 Duperon ..... B30B 9/18 100/106
2009/0183971 A1 * 7/2009 Basaglia ..... B30B 9/121 100/117
2013/0199383 A1 * 8/2013 Horton ..... B30B 9/14 100/117
2013/0312624 A1 * 11/2013 Cone ..... B30B 9/125 100/117
2014/0007783 A1 * 1/2014 Scheeres ..... B30B 1/186 100/117
2014/0326148 A1 * 11/2014 Wootton ..... B30B 9/125 100/117
2015/0165709 A1 * 6/2015 Miller ..... B30B 9/12 100/117
2015/0224730 A1 * 8/2015 Kanzler ..... B30B 9/121 100/117
2015/0283778 A1 * 10/2015 Long ..... B30B 9/124 100/117
2016/0023132 A1 * 1/2016 Bechtl ..... B01D 29/35 210/225
2016/0067637 A1 * 3/2016 Roiss ..... B01D 29/118 210/405
2017/0303723 A1 * 10/2017 Sedlmaier ..... B30B 9/14 99/501

* cited by examiner

SCREW PRESS FOR SEPARATION OF LIQUID FROM BULK MATERIALS

BACKGROUND

The present invention relates to processing of bulk materials. More particularly, the present invention relates to separation of liquids from bulk materials and to a screw press arrangement for separating liquids from bulk materials such as livestock manure.

Numerous industries utilize compression devices such as screw press liquid separators to remove liquid from bulk materials such as wood chips, livestock manure, byproducts of food processing operations, or other fibrous materials. The screw press liquid separators are based on the principle of a screw rotating inside a cylindrical or conical cage that forces the bulk material from the inlet of the screw to an output in a manner that compresses the bulk material. The cage can be equipped with holes, usually conically drilled, or slots or bars arranged in such a fashion as to provide for drainage of the liquid that is squeezed from the bulk material.

The various uses of screw press liquid separators involve a number of mechanisms for creating pressure between the chamber and the shaft bearing flights. The inner diameter of the chamber may be cylindrical, conical, or may contain restricted areas. All of these features together with variations in the diameter of the shaft or diameters of the flutes on the shaft can produce changes in the pressure exerted on the wood chips or other material being treated in the screw press liquid separator. The chamber of the plug screw feeder may be comprised of bars, screens or be solid depending upon whether the screw press liquid separator is being used to drive off excess water from materials such as livestock manure or being used to refine materials such as wood chips or both remove excess fluid and refine. In various applications the pressure and throughput is controlled by the voids if any in the chamber, the restrictions in the chamber, the shaping of the shaft or flutes and the torque applied to the screw feeder. Numerous examples of screw press liquid separators are known in the art.

U.S. Pat. No. 5,515,776 discloses a worm screw press having drainage perforations in the press jacket. The size of the shaft for the worm screw increases in cross-sectional area in the flow direction of the drained liquid.

U.S. Pat. No. 7,357,074 is directed to a screw press with a conical dewatering housing with a plurality of perforations for the drainage of water from bulk solids compressed in the press. A perforated casing or jacket is used.

U.S. Pat. No. 3,394,649 discloses a worm press used for the dewatering of sludges or cellulose pulp suspensions and comprises a hollow worm shaft having apertures at the end of the pressure zone. Through these bores still further liquid can be drained into the hollow shaft, this liquid draining inside the shaft in a direction opposite to the conveyance direction.

These prior-art worm screw configurations appear to operate for their intended purposes, but require the use of tapering screws, screw jackets or both, or require hollow shafts with provision for drainage. All of these features complicate their construction.

Therefore, there is a need for a new screw press arrangement for separating liquids from bulk materials which is not associated with these disadvantages.

SUMMARY

The present invention relates to a screw press liquid separator. The screw press liquid separator includes an elongated housing having an inlet end and a discharge end. A perforated screw cradle is disposed within the housing and has an inlet portion having a material inlet disposed at the inlet end of the housing and a compression portion. A screw formed on a shaft is disposed within the screw cradle. A first portion of the screw extends from an input end and a second portion of the screw extends to a discharge end and is completely surrounded by the compression portion. A first portion of the shaft has a first diameter extending from the input end to the discharge end of the screw, and a second portion of the shaft disposed within the compression portion of the screw cradle-extending past the output end of the screw has a second diameter larger than the first diameter. A transition portion of the shaft disposed between the first and second portions has a diameter that tapers from the second diameter to the first diameter. A first discharge guide extends from a top portion of the discharge end of the housing and a second discharge guide extends from a bottom portion of the discharge end of the housing. Two opposing discharge doors are pivotally mounted to the discharge end of the housing and are movable within a volume defined by the first and second discharge guides. The discharge doors are biased to close together against the discharge end of the housing. A plurality of paddles are affixed to and radially extend from the shaft at a position beyond an arc defined by pivotal motion of the discharge doors. A motor is rotatably coupled to the shaft.

BRIEF DESCRIPTION OF THE DRAWINGS

These and other features, aspects and advantages of the present invention will become better understood with regard to the following description, appended claims, and accompanying drawings where:

DESCRIPTION

In the following description, numerous specific details are set forth in order to provide a more thorough description of the present invention. It will be apparent, however, to one skilled in the art, that the present invention may be practiced without these specific details. Other embodiments of the invention will readily suggest themselves to such skilled persons having the benefit of this disclosure. In some instances, well-known features have not been described in detail so as not to obscure the invention.

Figure 1:
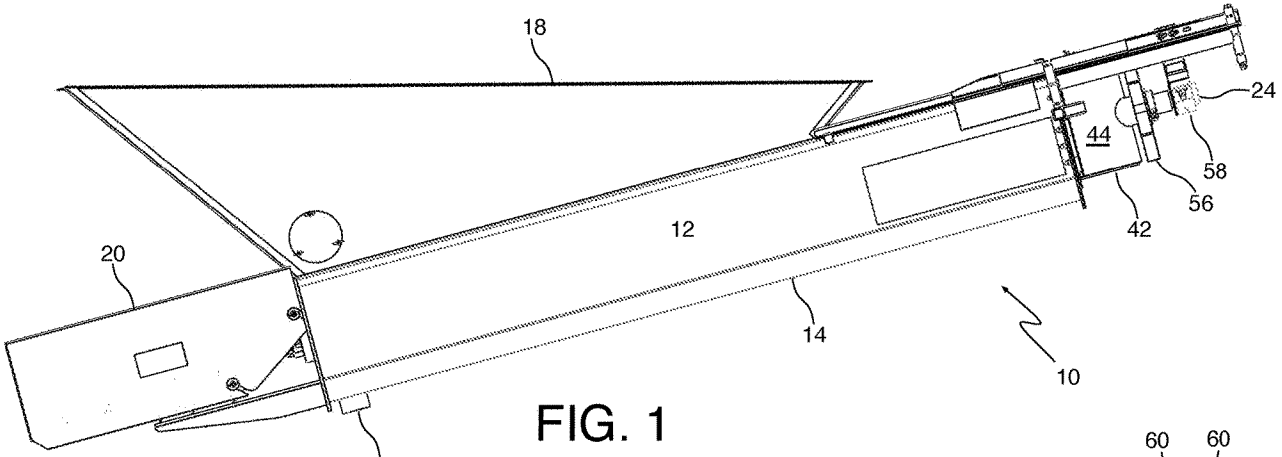
FIG. 1 is an isometric diagram showing an illustrative screw press liquid separator in accordance with one embodiment of the invention.
Figure 2:
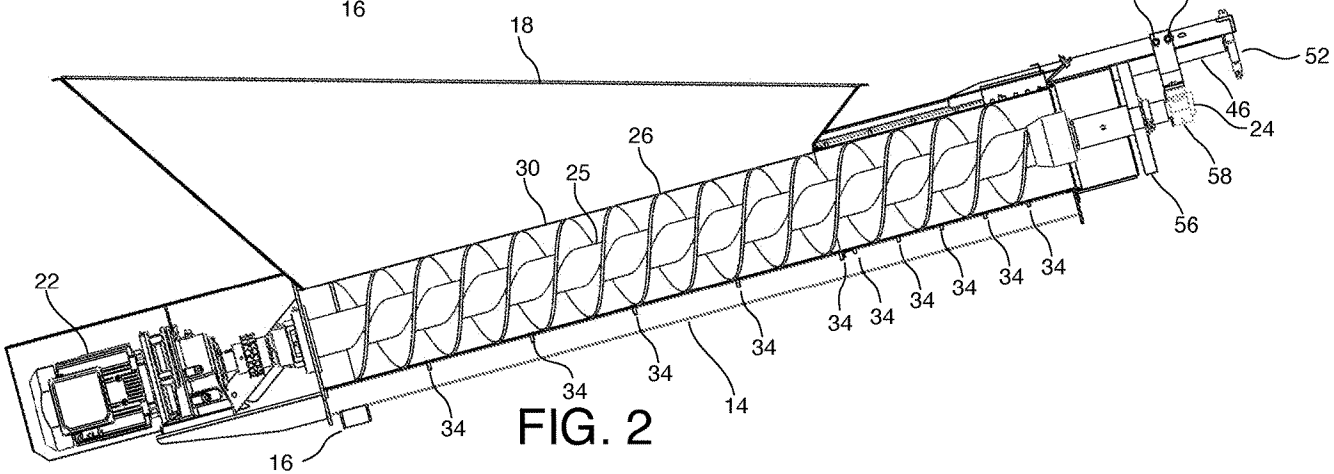
FIG. 2 is a diagram showing the illustrative screw press liquid separator of FIG. 1 with a front portion of the housing and screw cradle cut away.

Referring first to FIGS. 1 and 2, drawings present a side view of an exemplary embodiment of a liquid-extraction screw press 10 in accordance with one embodiment of the present invention. Screw press 10 is disposed within an enclosure 12, formed from a material such as sheet steel. In use, screw press 10 is disposed at an angle, for example 15°, to allow extracted liquid to run down a channel 14 formed at the bottom of enclosure 12 to an outlet opening 16. A hopper 18 is provided for loading bulk material into the screw press 10.

In FIG. 1 a shroud 20 is shown covering motor 22, which is visible in FIG. 2, in which the shroud 20 has been removed. Motor 22 drives screw shaft 24 to which screw 26 is attached.

Screw 26 is disposed in a screw cradle 28. Screw cradle 28 is formed from perforated sheet metal to allow extracted liquid to exit the screw cradle 28. The clearance between the screw and the cradle should be enough to allow free motion of the screw within the cradle but tight enough to prevent solids in the bulk materials from becoming trapped between the outer edges of the screw and the inner walls of the screw cradle. In a non-limiting exemplary embodiment of the invention used to press the liquid from cow manure, a 12-inch diameter screw is disposed within a screw cradle having a 12.125-inch diameter. Persons of ordinary skill in the art will appreciate that the clearance will be affected at least in part by the nature of the bulk material being processed, the average size of solids in the material, as well as the size of debris that may be expected to be encountered in the bulk material.

Figure 4:
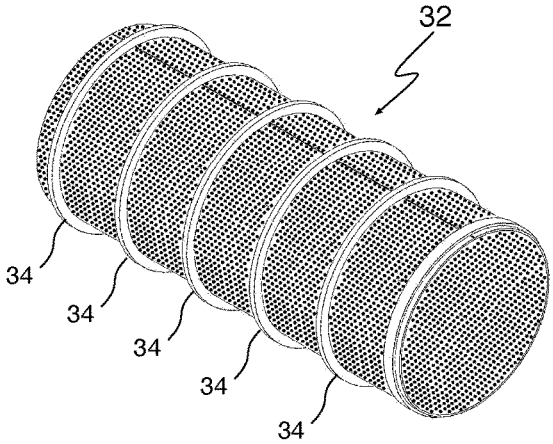
FIG. 4 is an isometric view showing the cylindrical compression portion of an illustrative screw cradle that may be employed in the present invention.

A first portion 30 of the screw cradle 28 below inlet hopper 18 is u-shaped with an open top to permit the bulk material to be introduced into screw press 10. A second portion 32 of screw cradle 28, shown in isometric form in FIG. 4, is cylindrical in shape. Both the u-shaped and cylindrical portions 30 and 32 of the screw cradle 28 are reinforced by ribs 34 to prevent pressure due to compression of the bulk material from distorting its shape and allowing the bulk material to pass between the edges of screw 26 and the inner wall of both portions 30 and 32 of the screw cradle 28.

Figure 3:
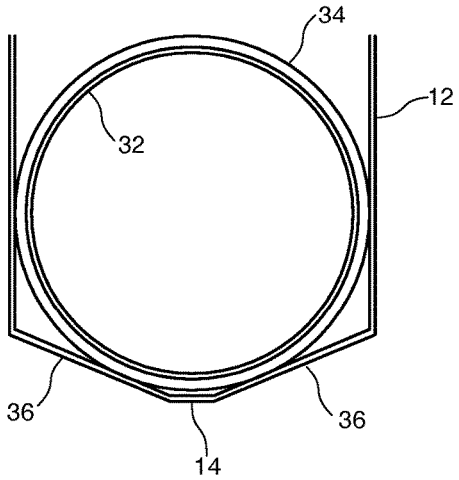
FIG. 3 is a diagram showing a cross-sectional view of the enclosure and screw cradle of the screw press liquid separator of FIG. 1 in a region where screw cradle is cylindrical in shape.

FIG. 3 shows a cross section of enclosure 12 and screw cradle 28 in a region where screw cradle 28 is cylindrical in shape. Bottom surfaces 36 of enclosure 12 are angled to direct the flow of extracted liquid into extraction channel 14 where it is further directed downward to outlet opening 16.

FIG. 4 is an isometric view of the cylindrical portion 32 of the screw cradle 28, showing the circumferential reinforcing ribs 34 employed to prevent distortion of the screw cradle from the pressure exerted on its inner wall by the bulk material.

Figure 5:
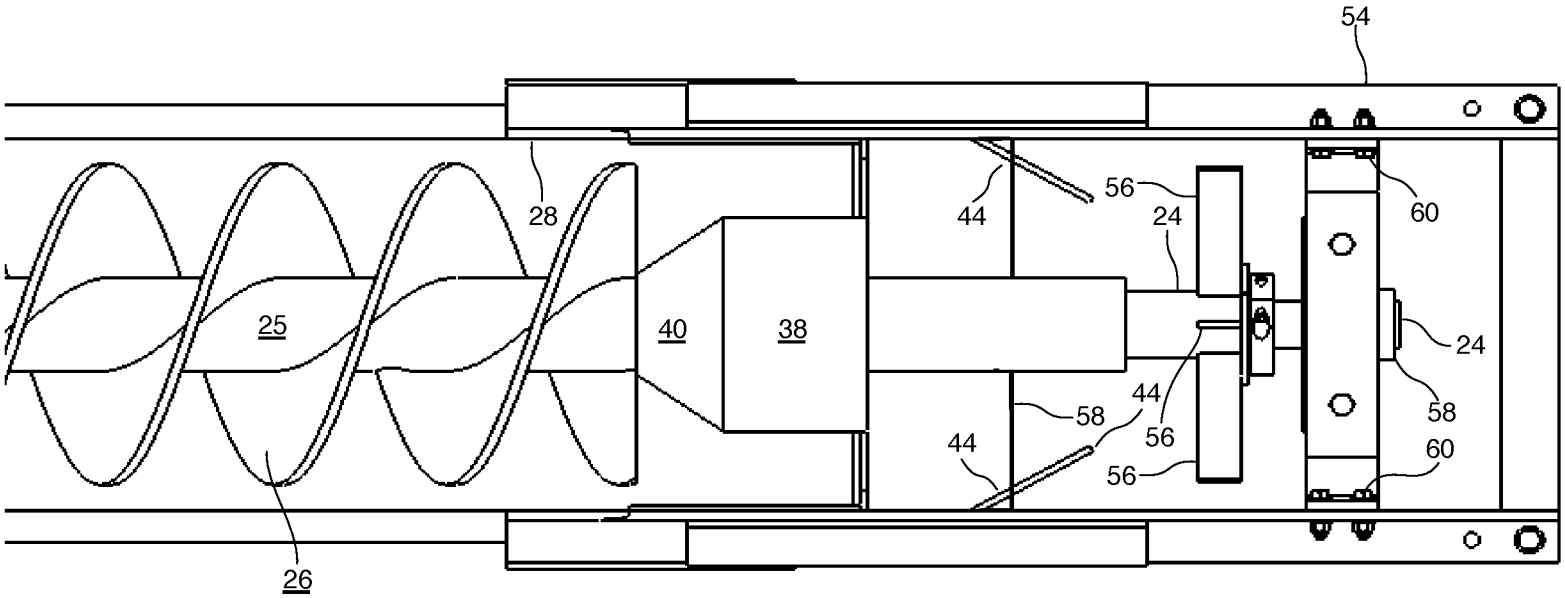
FIG. 5 is a top view of a portion of the screw press of FIG. 1 toward its exit end in the region where the screw cradle is cylindrical in shape.

FIG. 5 is a top view of a portion of the screw press 10 toward its exit end in the region where screw cradle 28 is cylindrical in shape. According to one aspect of the present invention depicted in FIG. 5, the screw shaft 24 includes a first portion 25 running the length of the screw 26 that has a first diameter and a second portion 38 that extends beyond the outlet end of screw 26 having a second diameter greater than the first portion of the screw shaft on which screw 26 is disposed. The diameter of screw shaft 24 increases along a transition region 40 between the first diameter and the second diameter.

As the bulk material is driven through the screw cradle in the area of the transition region 40 of the screw shaft, the pressure exerted on the bulk material increases as the volume defined by the cylindrical portion 32 of the screw cradle decreases, thus forcing more of the liquid out of the bulk material. According to the present invention, the decrease in volume defined by the cylindrical portion 32 of the screw cradle should be enough to exert significant extra pressure on the bulk material but not so much that it restricts the flow of bulk material to the point where it binds the screw or deforms the screw cradle. In an exemplary non-limiting embodiment of the invention extracting liquid from cow manure having a 12-inch diameter screw disposed in a 12.125-inch interior-diameter cradle, the first diameter of the screw shaft is about 3.50 inches, and the second diameter of the screw shaft in region 38 is about 6 inches, and the transition region 40 has a length of about 6-8 inches over which the diameter of the shaft increases linearly, although persons of ordinary skill in the art will appreciate that the diameter of the screw shaft could increase other than linearly over the length of the transition region 40. In any actual embodiment of the present invention, the minimum increase in shaft diameter can be selected to be large enough to compress the bulk material sufficiently to extract liquid, and the maximum increase in shaft diameter can be selected to avoid binding and jamming the screw press. As will be readily appreciated by persons of ordinary skill in the art, selection of the minimum and maximum shaft diameter values for any particular application will depend on factors including the diameter of the screw, the desired speed at which the screw will be rotated, and the nature of the bulk material being processed, including the compressibility and average size of the solid material components of the bulk material. As a starting point, the maximum shaft diameter can be approximately half of the diameter of the screw. This value can be adjusted empirically.

Figure 6:
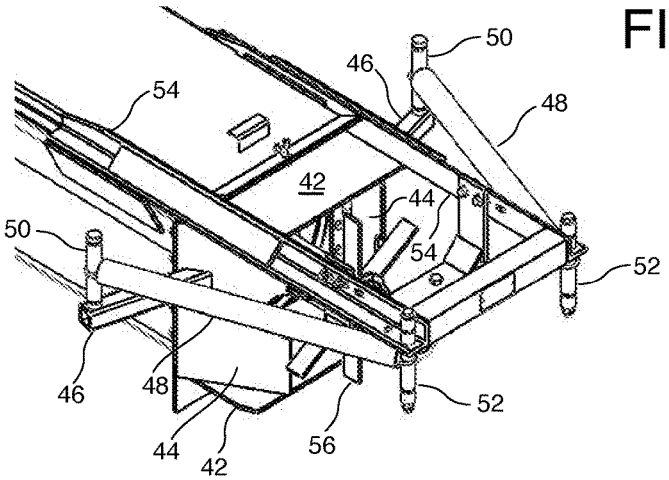
FIG. 6 is an isometric view of the outlet portion of the screw press liquid separator of the present invention.

Referring again to FIG. 5, and to FIG. 6, an isometric view of the outlet portion of the screw press liquid separator of the present invention, another aspect of the present invention is shown. As the bulk material exits the outlet end of the cylindrical portion 32 of the screw cradle, it is guided at the top and bottom by upper and lower guides 42. Along the sides of the enclosure 12, the bulk material presses against and urges open a pair of opposed discharge doors 44. As is best seen in FIG. 6, a lever 46 extends from the outer surface of each of the discharge doors 44 and a spring 46 is stretched between a spring holder 50 mounted on each of the levers and a spring holder 52 mounted on a frame member 54 of the enclosure 12 of the screw press. Each of the springs respectively biases its discharge door 44 towards a closed position across the outlet face of the enclosure 12. The bulk material being forced through the screw press 10 pushes against the discharge doors 44 urging them into an open position where the bulk material can exit the screw press 10. The force of the springs 48 further acts to compress the bulk material passing through the screw press 10 and forces the extraction of more liquid from the bulk material. Both FIGS. 5 and 6 show doors 44 in a partially opened position.

Referring again to FIG. 5 and FIG. 6, another aspect of the present invention is shown. A plurality of paddles 56 are each radially mounted on screw shaft 24 at a position beyond an arc defined by pivotal motion of the discharge doors 44. Paddles 58 serve to break the exiting bulk material into aggregations having smaller effective diameters. FIG. 6 also shows the end of screw shaft 24 held in rotational bearing 58. Bearing 58 is affixed to frame 54 in a conventional manner as is known in the art, for example by bolts shown at reference numeral 60 in FIGS. 2 and 5.

Although the present invention has been discussed in considerable detail with reference to certain preferred embodiments, other embodiments are possible. Therefore, the scope of the appended claims should not be limited to the description of preferred embodiments contained in this disclosure.

What is claimed is:

1. A screw press liquid separator comprising:

an elongated housing having an inlet end and a discharge end;

a first discharge guide extending from a top portion of the discharge end of the housing;

a second discharge guide extending from a bottom portion of the discharge end of the housing;

a pair of opposing discharge doors pivotally mounted to the discharge end of the housing and movable within a volume defined by the first and second discharge guides, the discharge doors close at the discharge end of the housing;

a perforated screw cradle disposed within the housing and having an inlet portion having a material inlet disposed at the inlet end of the housing and a compression portion; and a screw defining an input end and a discharge end formed on a shaft and disposed within the screw cradle, the shaft extending beyond the discharge end of the housing, a first portion of the screw extending from the input end of the screw and a second portion of the screw extending to the discharge end of the screw and completely surrounded by the compression portion of the screw cradle, a first portion of the shaft having a first diameter extending from the input end to the discharge end of the screw, a second portion of the shaft disposed within the compression portion of the screw cradle and extending past the discharge end of the screw and having a second diameter larger than the first diameter, and a transition portion of the shaft disposed between the first and second portions having a diameter tapering from the second diameter to the first diameter;

a motor rotatably coupled to the shaft.

2. The screw press liquid separator of claim 1 further including an inlet hopper disposed at the inlet end of the housing and communicating with the material inlet of the screw cradle.

3. The screw press liquid separator of claim 1 wherein the discharge doors are each biased by mechanical springs.

4. The screw press liquid separator of claim 1 wherein the inlet portion of the perforated screw cradle has a u-shaped cross section and the compression portion has a circular cross section.

5. The screw press liquid separator of claim 1, further comprising a plurality of paddles affixed to and radially extending from the shaft at a position beyond an arc defined by pivotal motion of the discharge doors.

6. A screw press liquid separator comprising:

an elongated housing having an inlet end and a discharge end;

a perforated screw cradle disposed within the housing and having an inlet portion having a material inlet disposed at the inlet end of the housing and a compression portion;

a screw defining an input end and a discharge end formed on a shaft and disposed within the screw cradle, a first portion of the screw extending from the input end of the screw and a second portion of the screw extending to the discharge end of the screw and completely surrounded by the compression portion of the screw cradle, a first portion of the shaft having a first diameter extending from the input end to the discharge end of the screw, a second portion of the shaft disposed within the compression portion of the screw cradle and extending past the discharge end of the screw and having a second diameter larger than the first diameter, and a transition portion of the shaft disposed between the first and second portions having a diameter tapering from the second diameter to the first diameter;

a first discharge guide extending from a top portion of the discharge end of the housing;

a second discharge guide extending from a bottom portion of the discharge end of the housing;

a pair of opposing discharge doors pivotally mounted to the discharge end of the housing and movable within a volume defined by the first and second discharge guides, the discharge doors close at the discharge end of the housing;

a motor rotatably coupled to the shaft; and a plurality of paddles affixed to and radially extending from the shaft at a position beyond an arc defined by pivotal motion of the discharge doors.

7. The screw press liquid separator of claim 6 further including an inlet hopper disposed at the inlet end of the housing and communicating with the material inlet of the screw cradle.

8. The screw press liquid separator of claim 6 wherein the discharge doors are each biased by mechanical springs.

9. The screw press liquid separator of claim 6 wherein the inlet portion of the perforated screw cradle has a u-shaped cross section and the compression portion has a circular cross section.

10. The screw press liquid separator of claim 6, further comprising a plurality of paddles affixed to and radially extending from the shaft at a position beyond an arc defined by pivotal motion of the discharge doors.

* * * * *